United States Patent [19]

Schrader

[11] Patent Number: 4,522,010

[45] Date of Patent: Jun. 11, 1985

[54] METHOD OF CONSTRUCTING A LARGE SPHERICAL TANK SUPPORTED BY A SKIRT ON LAND

[75] Inventor: Rolf F. Schrader, Moss, Norway

[73] Assignee: Moss Rosenberg Verft A/S, Moss, Norway

[21] Appl. No.: 479,454

[22] Filed: Mar. 28, 1983

[30] Foreign Application Priority Data

Apr. 15, 1982 [NO] Norway ..... 821241

[51] Int. Cl.[3] ..... E04G 21/14

[52] U.S. Cl. ..... 52/745; 220/5 A

[58] Field of Search ..... 52/741, 745, 245, 247, 52/249, 194, 169.6, 169.7; 220/1 B, 5 A, 3, 69, 70; 248/DIG. 1

[56] References Cited

U.S. PATENT DOCUMENTS

| | | | |
|---|---|---|---|
| 879,196 | 2/1908 | Sargent | 220/5 A |
| 1,026,059 | 5/1912 | Smith | 220/69 |
| 1,602,664 | 10/1926 | Hague | 52/247 |
| 1,958,487 | 5/1934 | Moran | 52/169.6 |
| 2,363,992 | 11/1944 | Reiser | 220/1 B |
| 2,562,601 | 7/1951 | Caquot et al. | 52/169.6 |
| 2,562,602 | 7/1951 | Caquot | 220/18 |
| 3,956,816 | 5/1976 | Short | 52/2 |

*Primary Examiner*—James L. Ridgill, Jr.
*Attorney, Agent, or Firm*—Pasquale A. Razzano

[57] ABSTRACT

In the construction of a large, land-based skirt-supported spherical tank, the tank is partially prefabricated, its bottom polar cup section being produced ready for mounting and stored inside the rest of the spherical shell. In this state, wherein the transportation height of the tank has been substantially reduced, the as yet unfinished spherical tank is transported to the erection site, where the bottom polar cap section is lowered into position and secured to the rest of the spherical shell.

9 Claims, 13 Drawing Figures

METHOD OF CONSTRUCTING A LARGE SPHERICAL TANK SUPPORTED BY A SKIRT ON LAND

Figure 1:
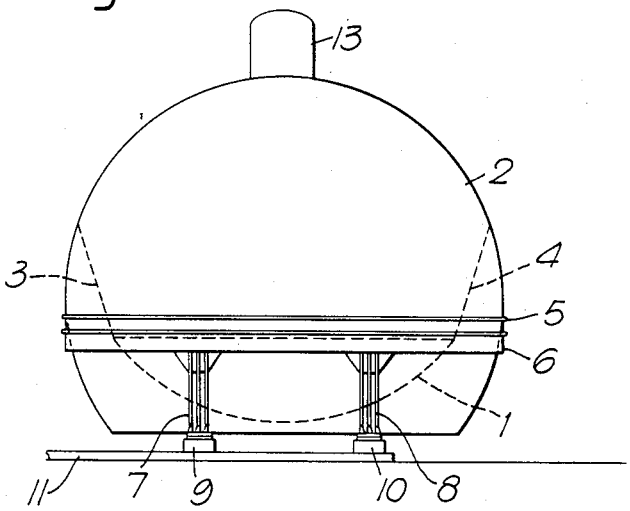

The invention relates to a method of constructing large, land-based, skirt-supported spherical tanks. The invention has been especially developed in connection with the need for constructing storage facilities with spherical storage tanks for liquid gas on land.

Land-based storage tanks for liquefied gas must satisfy a number of conditions, especially if they are being used to store LNG (liquefied natural gas). There must be little heat leakage, that is the insulation must be thick. Moreover, good moisture protection for the insulation must be provided owing to the great differences in temperature. Protection against environmental factors such as temperature variations, earthquakes, wind, precipitation, etc. must also be provided, and the land-based storage tanks must also be protected against external influences such as "missiles". In a number of instances, also, means must be provided to make sure that in the event of a leak or fracture in the primary tank, any liquefied gas which has leaked out will be collected.

These requirements in effect define the level of safety and operational reliability of the facility. Other desirable considerations relate to measures for saving costs on construction and operation, simple and speedy construction, etc. Lately, the desire for a simple construction method requiring a limited labor force at the assembly or installation site has been emphasized. This can be obtained through prefabrication. The prior art, skirt-supported spherical tanks made in accordance with the MRV (Moss-Rosenberg) concept can be completely prefabricated at suitable workshop facilities, for example at a shipyard. The spherical tanks can then be transported to the installation site on barges and transferred to land via skids.

A particular advantage of using spherical tanks as storage tanks is their safety and operational reliability. Very good experience has been gained with such tanks from maritime applications. A special advantage is that extensive insulation is not required between the tank support and the ground, as is the case if large upright cylindrical tanks with flat bottoms are utilized.

According to the invention, a method of constructing a large, land-based, skirt-supported spherical tank is proposed. In the present case, the term "large spherical tank" means tanks having an inside diameter normally exceeding 20 meters, often being 25 meters or more. As mentioned above, such large spherical tanks can be prefabricated at a suitable location and transported by sea to an erection site near the coast, and the tanks can be transferred to land in a relatively easy manner using skids. With the large tank dimensions in question, the height of the unit and the actual bulk or size of the spherical tank structure represent a problem during transportation. There is thus a need to reduce the bulk of the unit, for example to reduce its wind resistance and to lower its center of gravity during transportation. Such large spherical tanks can naturally be prefabricated in large sections for subsequent assembly at the erection site, but this requires additional land area for temporary storage of the sections and additional use of resources at the assembly/installation site. According to the invention, therefore, a construction method is proposed whereby the advantage of prefabrication is combined with the advantage of transporting smallervolume units. This is obtained by partially prefabricating the spherical tank, in that the lower polar cap section is constructed but not welded to the rest of the spherical shell, transporting the prefabricated structure to the installation site with the lower polar cap section supported inside the rest of the spherical shell, thereby reducing the height of the transported unit, and lowering said polar cap section into position and securing it to the rest of the shell at the installation site.

Preferably, a concrete skirt which is provided at the installation site is utilized as a permanent skirt support.

During transportation, the prefabricated structure is preferably supported by a temporary support structure in the region which later will become the skirt region. This temporary support structure can be removed when the permanent skirt is constructed at the installation site, or the temporary structure may become part of the permanent skirt.

For example, a permanent partical skirt can be provided at the installation site which forms a cradle into which a prefabricated structure is placed, this partial skirt structure immediately assuming part of the support function for the tank, and the rest of the skirt support can then be fabricated on-site. According to a preferred embodiment of the invention, the spherical tanks for the planned tank facility, made in accordance with the MRV concept, are produced at a suitable location. The equatorial ring, which is an important element in this concept, is supported during the construction of each spherical tank at four points or regions. The lower polar cap section of the sphere is not welded to the rest of the shell, but is suspended inside the tank. The structure which has been prefabricated in this manner is then transferred to a barge on a slideway formed by skids, being supported via the skirt ring at four points or regions. At the installation site a central slideway is provided between the quay or pier for the barge and the final assembly/erection area for the tanks. The distance between the two skids which form the slideway will be determined by the conditions pertaining at the site where the tanks are prefabricated. At right angles to the main slideway, branch slideways are provided to each tank erection site. At the erection site, the bottom polar cap section is then lowered into position and the unit assembled by welding.

When the tank is being prefabricated, the lower part of the internal tower or towers is not mounted in position; the members are temporarily stored inside the tank and welded in place after the lower polar cap section has been correctly positioned.

In accordance with the invention, it may be advantageous to provide a hollow at the erection site to provide room for lowering the lower polar cap section of the spherical tank into place. The tank support means at said four points or regions are disposed such that the distance between the two skids on which they rest will be wide enough to provide room for the hollow to fit between the two skids without any special arrangements being necessary.

Alternately, the construction hollow can be omitted. In that case, one must first jack up or elevate the prefabricated structure at the erection site to make room for the lower polar cap section. In the case of especially large spherical tanks, however, use of the construction hollow is preferred. The advantages of using such a depression are numerous; for example, the construction height is lower, and less (a smaller part) of the tank is exposed to external stresses and loads, which results in markedly lower costs.

The method of the invention, comprising prefabrication followed by transportation of the unit to the assembly site, requires little use of resources at the assembly site. The method does not require additional areas for temporary storage of tank sections.

After the tank has been positioned, one can cast the concrete skirt, if such a skirt is being used. As mentioned above, part of the skirt can already have been precast at the erection site. In that case, the next step will be to cast a corresponding part on the opposite side of the tank, transfer the weight of the tank to the two concrete members, remove the temporary supports used for the skid transportation of the tank, and then complete the skirt. Another possible method is to cast the entire concrete skirt in one piece, e.g. by slip-form casting. If this method is utilized, the temporary support members will have to be embedded inside the concrete (sacrificed), optionally after the skid pillows have been replaced with extension members and height adjustments undertaken. If the latter method is used, it may be desirable to increase the thickness of the concrete at the regions where the support members are embedded within the skirt support.

Owing to the high weight loads, and taking into account possible additional loads from an earthquake, the metal part of the skirt must be secured very solidly to the concrete. For this purpose, the metal part of the skirt may be provided with suitable anchoring members in the form of flat sections welded thereon and/or other anchoring members such as round sections which are inserted through bores in the metal part. The concrete skirt can then be slip-form cast up to a suitable height, without any form of being necessary after the tank has been brought into the correct position.

In the case of the alternative method in which the concrete skirt is cast in several parts, a plurality of intermediate members are used to support the metal skirt, and thereby the spherical tank, after the temporary skid supports have been removed. It is then practical to utilize a plurality of jacks for transferring the weight and for fine-adjustment of the tank height. Suitable recesses for the jacks are formed during the casting.

Figure 2:
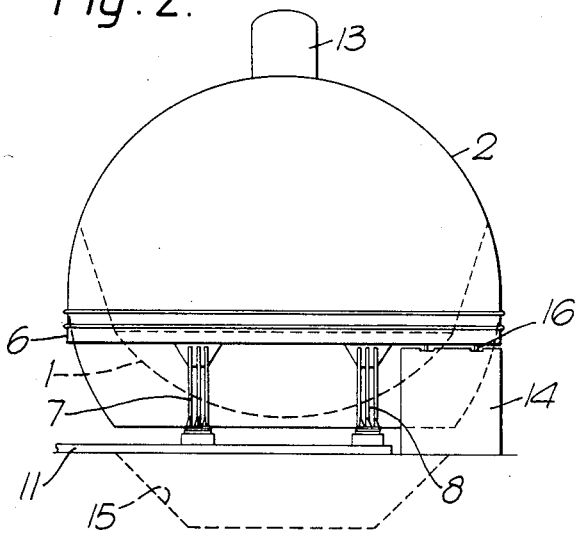
Figure 3:
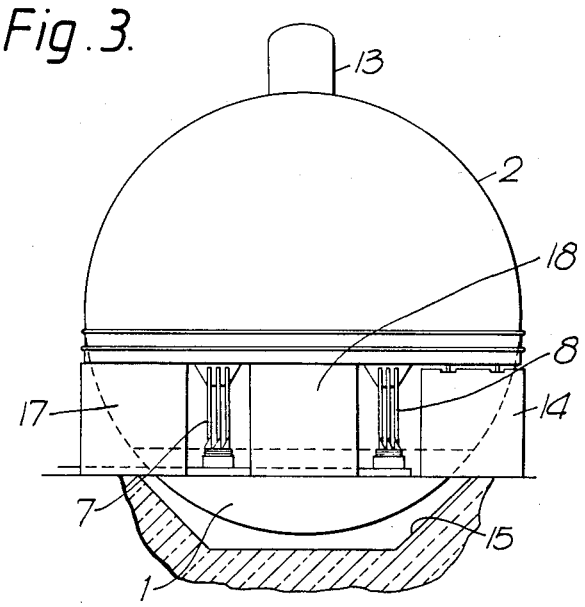
Figure 4:
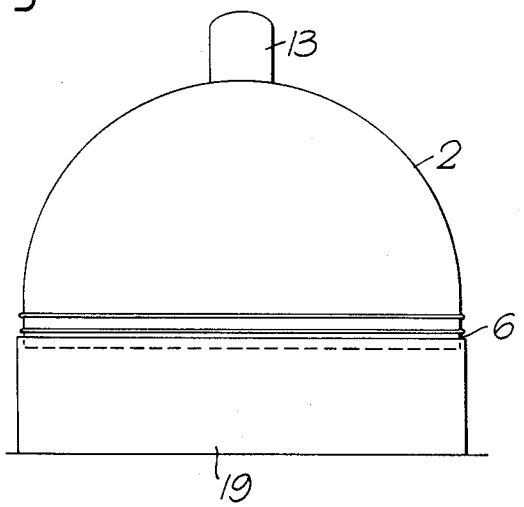
Figure 5:
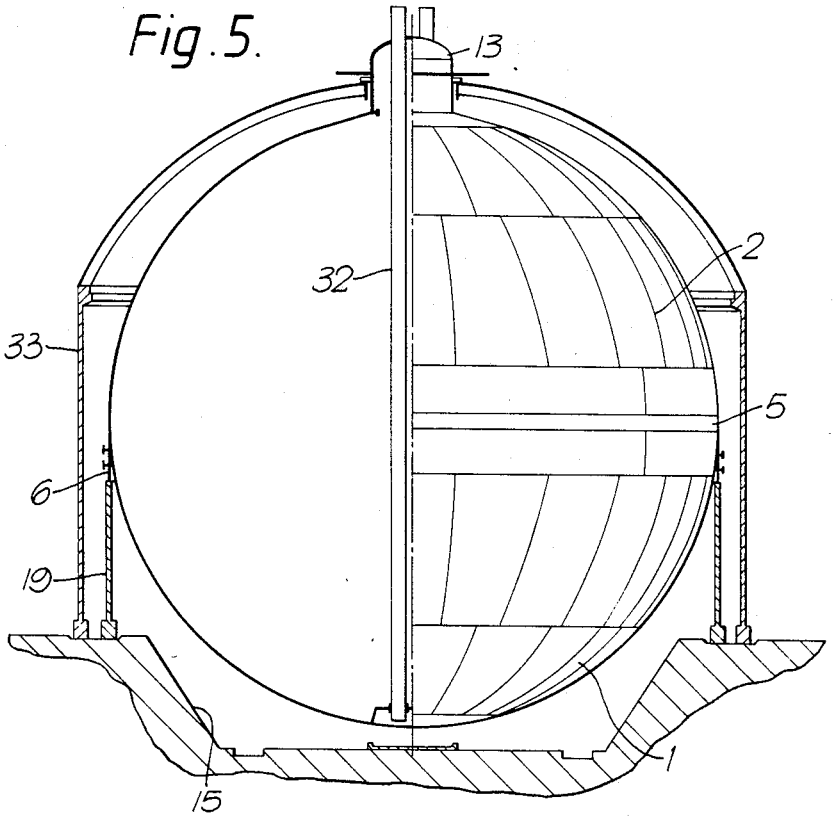
Figure 6:
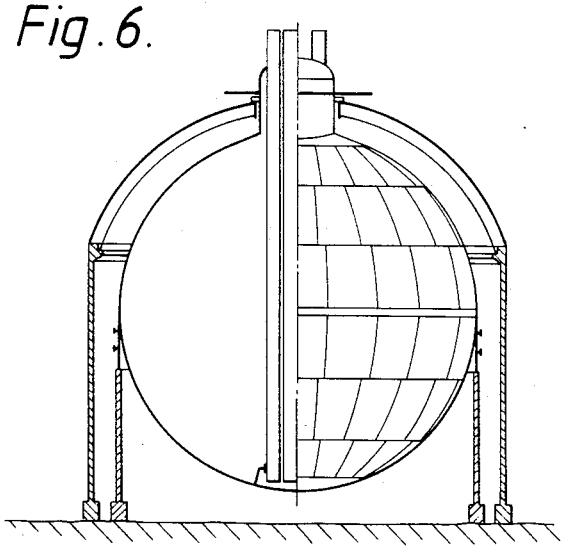
Figure 7:
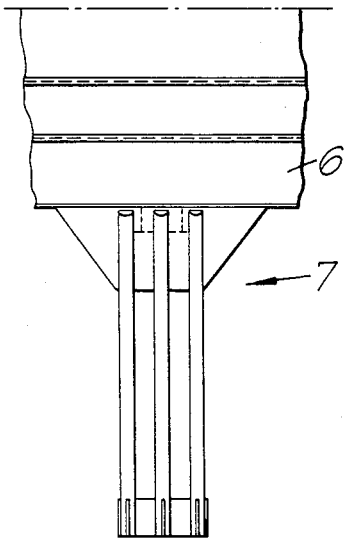
Figure 8:
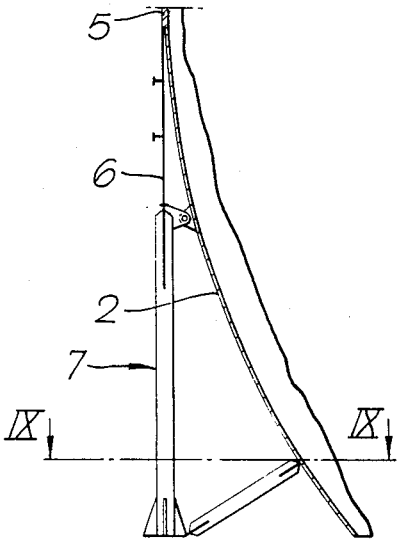
Figure 9:
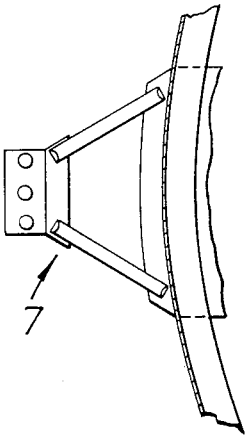
Figure 10:
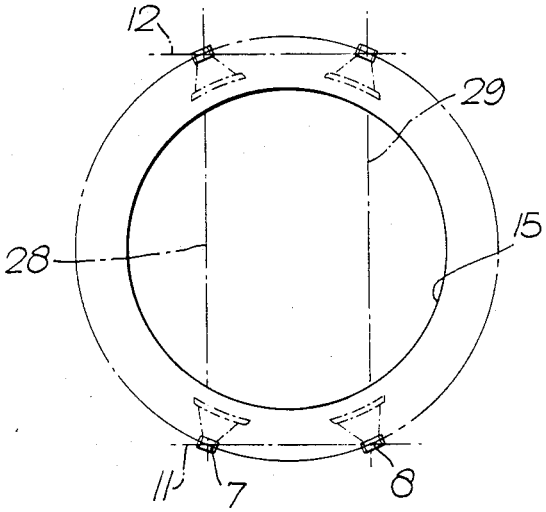
Figure 11:
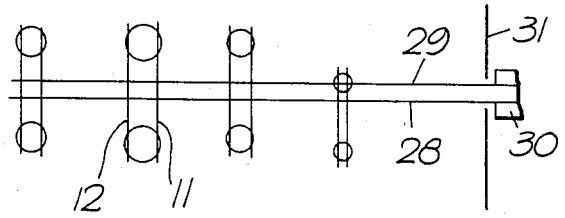
Figure 12:
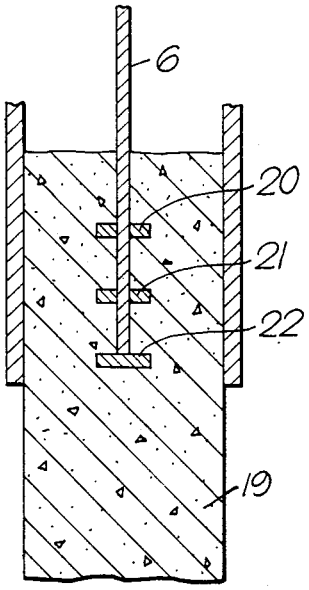
Figure 13:
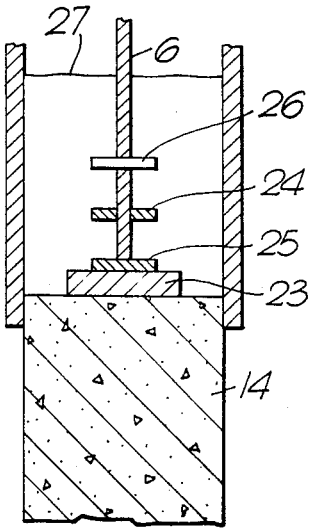

The invention will be described in greater detail in the following with reference to the accompanying schematic drawings, wherein FIG. 1 shows a prefabricated tank structure ready for skid transportation, with temporary supports, FIG. 2 shows the tank after it has been transported on skids to the erection site, in position above a construction hollow, FIG. 3 shows the tank with the lower polar cap section secured in position and with parts of the supporting skirt pre-made, FIG. 4 shows the spherical tank upon completion of its installation at the erection site, FIG. 5 is a cross section through the erected tank of FIG. 4 and an associated protective concrete silo, drawn on a larger scale, FIG. 6 shows a completed, installed spherical tank and associated protective concrete silo in cross section, mounted without using a construction hollow, FIG. 7 shows in vertical projection a temporary support of the type utilized in FIGS. 1, 2 and 3, FIG. 8 shows the support of FIG. 7 in side view, FIG. 9 shows a schematic section along the line IX—IX in FIG. 8, FIG. 10 is a schematic plan view showing the temporary supports and their placement, FIG. 11 is a diagram of an installation site, showing the skid paths and erection sites for the spherical tanks, FIG. 12 is a cross section through part of a concrete skirt during casting with slip forms, and shows a possible way of anchoring the metal part of the skirt in the concrete, and FIG. 13 shows another casting method, utilizing intermediate members between a precast concrete skirt section and the metal skirt, at the stage where one is ready to finish the casting of the rest of the skirt.

FIG. 1 shows a partially fabricated, large spherical tank, ready for transportation. The spherical tank is not completely fabricated. Its bottom polar cap section has been fabricated, but instead of securing it in position, the lower polar cap has been placed inside the rest of the shell, i.e., the upper part of the spherical tank 2. The bottom polar cap section 1 is suspended inside the upper part of the spherical tank 2 with the aid of suitable means that are merely indicated by the broken lines 3 and 4 in FIG. 1. The spherical tank is constructed according to the familiar MRV concept, and thus has an equatorial ring 5 which forms part of the spherical shell. Projecting downwardly from the equatorial ring is a short metal skirt 6. The spherical tank is temporarily supported by supports 7, 8 which extend from the bottom edge of the metal skirt 6 down to skid pillows 9, 10 which rest on a skid 11. In FIG. 1, only two supports 7 and 8 are visible on one side of the spherical tank. Two corresponding supports are found on the hidden side of the spherical tank, with an associated skid which together with the skid 11 constitutes a slideway. See in this connection FIG. 10, where the second skid is indicated by numeral 12.

The dome 13 of the spherical tank is mounted on the tank, but the conventional internal tower is not mounted. The pieces of the tower are also temporarily stored inside the tank, but they cannot be seen in the drawings. The tower members are welded into position at the erection site.

The prefabricated structure shown in FIG. 1 is moved on skids 11,12 to a barge, for example, and is transported by sea to the installation site for the storage facility, where the tank structure is transported on skids to land and further to the erection site. In FIG. 2, the prefabricated structure is shown upon arrival at the erection site, where in this case a partial skirt 14 of concrete has been erected beforehand, forming a cradle into which the structure is guided. A construction hollow 15 has also been excavated at the erection site. On top of the concrete skirt member 14, jacks 16 are indicated which are utilized for transferring the load to the concrete skirt member 14, the jacks working against the metal skirt 6. The prefabricated structure can be adjusted (leveled) using the jacks.

A corresponding skirt member of concrete is then cast on the opposite side, and the weight of the tank is transferred to the two concrete members. This is shown in FIG. 3, where the corresponding concrete skirt member is designated by numeral 17. In this case, too, jacks at the top of the concrete skirt may advantageously be utilized for final leveling, but leveling can also be performed by other suitable means, as desired. FIG. 3 also shows how a concrete skirt member 18 can be cast between the temporary supports 7, 8. In FIG. 3, the bottom polar cap section has been lowered into position and secured to the shell.

The temporary supports 7, 8 are removed and the concrete skirt is cast, and the finished, mounted spherical tank then looks like the drawing in FIG. 4, where the finished concrete skirt is designated 19. As shown, the metal skirt 6 is partially embedded in the concrete skirt 19.

Embedding and anchoring of the metal skirt 6 in the concrete skirt are important. Owing to the large weight loads, possibly augmented by earthquakes, the attachment of the metal part of the skirt to the concrete must be very secure. FIG. 12, in cross section, shows how this can be done by slip-form casting of the concrete skirt 19. As may be seen in the Figure, the metal skirt 6 is provided with anchor members 20,21,22, here in the form of flat sections welded to the skirt.

Starting from a precast part of the skirt, one can proceed as shown in FIG. 13, where intermediate members 23 are placed on top of the concrete skirt 14 for supporting the skirt 6. In this case, too, flat sections 24,25 have been welded to the metal skirt; in addition, the Figure illustrates how round sections 26 may be used for anchoring by inserting them into bores in the metal skirt. The rest of the concrete skirt can then be slip-form cast up to the desired height 27.

A typical example of one of the temporary supports 7,8 is shown in FIGS. 7,8 and 9. The special placement of the supports in the tank's skirt region is shown in FIG. 10.

The temporary support structures can naturally be formed in numerous ways, and the embodiment shown in FIGS. 7, 8 and 9 is meant only to serve as an example. As shown in these Figures, the support 7 is composed of three vertical pillars which extend down to a common foot at the bottom and are supported against the spherical tank with two diagonal stays.

FIG. 10 shows the construction hollow 15, and the outer circle indicated by a broken line represents the skirt of the spherical tank. It may be seen that the temporary supports 7,8 are placed in the skirt region in such manner in relation to each other that the slideway 11, 12 will pass on both sides of the construction hollow 15, so that no special measures have to be taken for placing the prefabricated structure in position above the hollow 15.

The broken lines 28, 29 indicate a possible skid path transversely of the slideway formed by the skids 11,12.

In the plan view of a land facility with spherical tanks shown in FIG. 11, the arrangement of the slideways is such that the "narrow gauge" skid paths 28,29 lead from a barge 30 at the quay 31 inland to the installation site. Branch paths lead to each erection site for each tank, with the wide gauge path represented by the skids 11 and 12 in FIG. 10. The circles shown in FIG. 11 indicate the erection sites and erected spherical tanks.

A finished, erected spherical tank with associated protective silo is shown in FIG. 5. This tank is the type illustrated in FIG. 4, and the reference numerals used are the same as in FIGS. 1–4. In the cross section on the left-hand side of FIG. 5, the internal tower 32 is shown installed in position. As mentioned above, the spherical tank is surrounded by a protective concrete silo, designated 33. The concrete silo is cast after the spherical tank has been installed in position at the erection site.

As already mentioned, the spherical tank may optionally be erected without using a construction hollow, and this is shown in FIG. 6. The main elements are the same as in FIG. 5, and the members seen in FIG. 6 should therefore require no further explanation. Before the bottom polar cap section is put in place after the tank has reached the erection site, the prefabricated structure naturally has to be elevated or raised to make room for the bottom polar cap beneath the upper portion of the spherical tank. The embodiment shown in FIG. 6 is best suited for spherical tanks of not too enormous dimensions, for example spherical tanks with a diameter of 20 meters. For purposes of comparison, the spherical tank shown in FIG. 5 might have a diameter of about 40 meters.

Having described my invention, I claim:

1. A method of constructing a large, land-based, skirt-supported spherical tank comprising the steps of, prefabricating said tank initially in two sections at a fabrication site by forming an upper, greater than hemispherical, tank section including a skirt support element and a bottom polar cap section, said upper tank section and said bottom polar cap section having complementary edges adapted to be joined at an erection site to form the completed tank, said edges defining a diameter smaller than the diameter of the completed tank, transporting the prefabricated tank sections to the erection site while supporting the bottom polar cap section inside of the upper tank section thereby reducing the height of the unit during transportation, lowering the bottom polar cap section at the erection site into position with said edges aligned and thereafter securing said bottom polar cap section to the upper section of the tank shell.

2. A method according to claim 1, including the step of forming a hollow in the ground at the erection site before the prefabricated structure is brought into position at the erection site to provide room for lowering the bottom polar cap section of the sherical tank.

3. A method according to claim 1, including the step of supporting the prefabricated upper tank section with said polar cap therein during transportation by the use of a temporary support construction engaged with said skirt support element.

4. A method according to claim 3 including the steps of forming at the erection site a partial support skirt arranged to fit between elements of the temporary support construction in position to be engaged with said skirt support element and assume the support function, positioning the upper tank section with its skirt support element over said partial support skirt, completing the support skirt below the tank's skirt support element and engaging the tank's skirt support element with the completed support skirt and thereafter removing the temporary support construction.

5. A method according to claim 3 including the steps of removing said prefabricated tank sections into position at the erection site, forming at the erection site a support skirt beneath the tank's skirt support element and in engagement therewith and with the temporary support construction thereby to make the temporary support construction a part of the permanent skirt constructed at the erection site.

6. In a method of constructing a large, land-based skirt-supported spherical tank, the steps of prefabricating the spherical tank at a fabrication site in two sections by forming an upper greater than hemispherical tank section including a skirt support element and a bottom polar cap section, said upper tank section and said bottom polar cap sections having complimentary edges adapted to be welded together at an erection site to form the completed tank, said edges defining a diameter smaller than the diameter of the completed tank, transporting the prefabricated tank section to the erection site while supporting the bottom polar cap section by suspending it inside the upper section of the spherical tank shell, thereby reducing the height of the unit during transportation, forming slideways for skid transportation of the tank to the erection site, said transportation step including moving the tank section along said slideways into a desired final position at the erection site, lowering the bottom polar cap section at the final position of the tank into position with said edges aligned and thereafter securing said bottom polar cap section of the tank shell along side edge.

7. A method according to claim 6, wherein said step of forming slideways includes the steps of forming at least first and second perpendicularly extending and intersecting slideways each consisting of a pair of parallelly extending skid slides, and the additional steps of forming a construction hollow at the erection site to provide room for lowering the bottom polar cap section, the distance between the parallel skid slides being made wide enough to give room for the construction hollow.

8. In a method of constructing a large, land-based skirt-supported spherical tank, the steps of prefabricating the spherical tank at a fabrication site in two sections by forming an upper greater than hemispherical tank section including a skirt support element and a bottom polar cap section, said upper tank section and said bottom polar cap section having complimentary edges adapted to be welded together at an erection site to form the completed tank, said edges defining a diameter smaller than the diameter of the completed tank, transporting the prefabricated tank section to the erection site while supporting the bottom polar cap section by suspending it inside the upper section of the spherical tank shell, thereby reducing the height of the unit during transportation, lowering the bottom polar cap section at the final position of the tank into position with said edges aligned and thereafter securing said bottom polar cap section of the tank shell along said edge and forming at the erection site a concrete skirt by using slip-form concrete construction and embedding said tank skirt support element secured to the tank within the concrete, including the step of anchoring the tank support skirt element in the concrete skirt.

9. In a method of constructing a large, land-based skirt-supported spherical tank, the steps of prefabricating the spherical tank at a fabrication site in two sections by forming an upper greater than hemispherical tank section including a skirt support element and a bottom polar cap section, said upper tank section and said bottom polar cap section having complimentary edges adapted to be welded together at an erection site to form the completed tank, said edges defining a diameter smaller than the diameter of the completed tank, transporting the prefabricated tank section to the erection site while supporting the bottom polar cap section by suspending it inside the upper section of the spherical tank shell, thereby reducing the height of the unit during transportation, lowering the bottom polar cap section at the final position of the tank into position with said edges aligned and thereafter securing said bottom polar cap section of the tank shell along side edge supporting the prefabricated upper tank section during said transportation step by a temporary support construction engaged with the tank's skirt support element, casting a concrete skirt in several sections at the erection site, supporting said upper tank sections on said concrete skirt sections by use of a plurality of intermediate members between said tank support skirt and said concrete skirt sections, removing the tank support construction, engaging a plurality of jacks between said concrete skirt sections and said tank support skirt element for transfering the tank weight therebetween and for fine adjustment of the tank height, and thereafter casting more concrete up to a desired level for anchoring said tank skirt support element in the concrete.

* * * * *